US005716266A

United States Patent [19]

Thompson

[11] Patent Number: 5,716,266

[45] Date of Patent: Feb. 10, 1998

[54] COIN DISPENSER

[75] Inventor: Trevor Thompson, Hants, England

[73] Assignee: Mars Incorporated, McLean, Va.

[21] Appl. No.: 640,912

[22] PCT Filed: Nov. 3, 1994

[86] PCT No.: PCT/GB94/02418

§ 371 Date: Jun. 13, 1996

§ 102(e) Date: Jun. 13, 1996

[87] PCT Pub. No.: WO95/13595

PCT Pub. Date: May 18, 1995

[30] Foreign Application Priority Data

Nov. 12, 1993 [GB] United Kingdom ..... 9323381

[51] Int. Cl.[6] ..... G07D 1/00

[52] U.S. Cl. ..... 453/44; 453/18; 194/344

[58] Field of Search ..... 453/18, 19, 20, 453/21, 40, 41, 44–48; 194/344, 345; 232/55, 64, 57.5; 221/193

[56] References Cited

U.S. PATENT DOCUMENTS

| | | | |
|---|---|---|---|
| 1,266,099 | 5/1918 | Brandt | 453/19 |
| 2,006,433 | 7/1935 | Bierstedt et al. | 232/57.5 |
| 4,250,905 | 2/1981 | Kobayashi et al. | 453/41 |
| 4,410,077 | 10/1983 | Okolischan | 194/344 |
| 4,926,998 | 5/1990 | Finegan | 194/315 |

FOREIGN PATENT DOCUMENTS

| | | | |
|---|---|---|---|
| 1 474 833 | 8/1969 | Germany . | |
| 1 302 503 | 12/1970 | Germany . | |
| 4207744 | 9/1993 | Germany | 453/41 |
| 90/13097 | 1/1990 | WIPO | G07F 3/00 |

*Primary Examiner*—F. J. Bartuska
*Attorney, Agent, or Firm*—Fish & Richardson P.C.

[57] ABSTRACT

A coin dispenser drops a coin 16 onto a surface 18 for transport to a dispensing area 14. To damp the circular rolling motion of the coin 16 after it falls onto the surface 18, the surface 18 has a strip 24 onto which the coin 16 rolls, thereby bringing the coin 16 quickly to rest.

5 Claims, 3 Drawing Sheets

COIN DISPENSER

BACKGROUND OF THE INVENTION

The present invention relates to a coin dispenser.

In some known types of coin dispensers, coins are stored in a number of storage tubes and are dispensed onto a surface from which they are laterally shifted to a dispensing area. For example, the dispensing area is typically restricted to a small allocated area, so that coins from at least some of the storage tubes, after being dropped onto the surface, need to be transported along the surface to the dispensing area.

However, as is well known, a coin dropped on a surface often performs a circular rolling motion before coming to rest. In many cases, it is not possible reliably to transport the coin along the surface until it has come to rest. Thus, a considerable delay must be introduced between the time of release of the coin and the start of the transport process along the surface, which slows the operation of the coin dispenser.

It is therefore desirable to bring a coin rapidly to rest after it is dropped upon a surface, so that the coin may be swiftly and reliably dispensed.

One known solution is to select the material of the surface such that the energy of impact of the coin is rapidly absorbed; however, this requires substantial modification of existing dispensers, and the use of such materials may be undesirable for other reasons.

SUMMARY OF THE INVENTION

The present invention provides a coin dispenser in which a coin is released onto a surface in such a way that it may execute a rolling motion in a circular path, including a projection positioned on the surface such that the coin contacts the projection while it is rolling and is thereby brought to rest.

The projection may be an elongate strip, either attached to or integrally formed with the surface. Advantageously, the strip is arranged so that the coin comes to rest with one end raised and resting stably on the strip, while the other end rests with its corner on the surface. The dispenser may further comprise a dispensing area into which the coin is dispensed, and means for transferring the coin from the surface to the dispensing area. Thus, the dispensing area may be reduced, since its size and position is not governed by the location of the storage tubes. The transferring means may comprise an arm arranged to push the coin along the surface towards the dispensing area. The arm may be arranged to pivot or to slide along the surface.

The dispenser may include a coin storage container positioned above the surface, and means for releasing one or more coins from the coin storage container and dropping them onto the surface.

BRIEF DESCRIPTION OF THE DRAWINGS

Specific embodiments of the present invention will now be described with reference to the accompanying drawings, in which.

DESCRIPTION OF THE PREFERRED EMBODIMENTS

Figure 1:
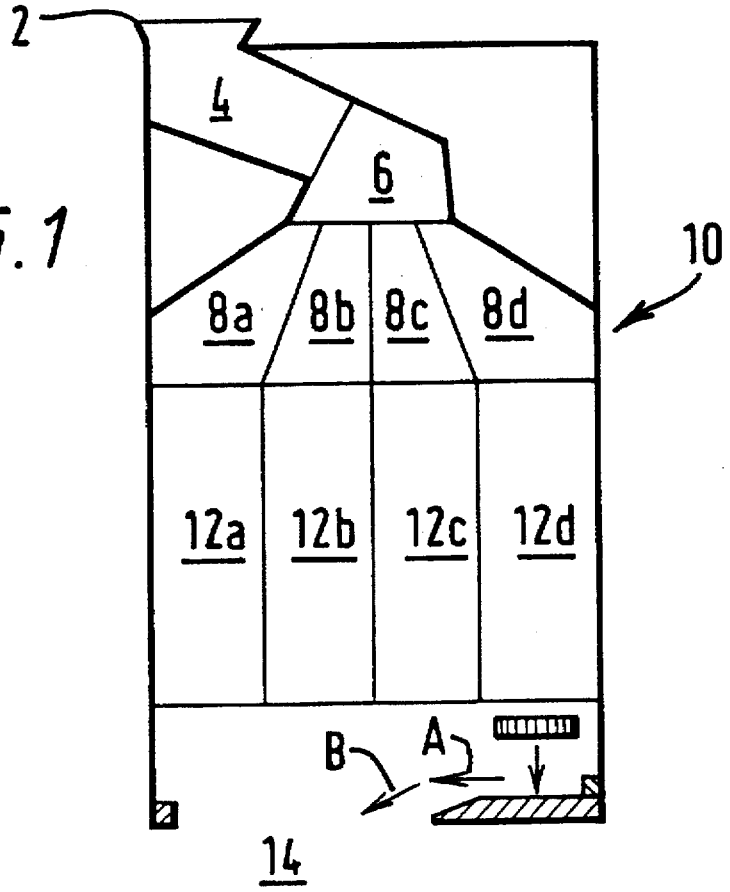
FIG. 1 is a schematic elevation of a coin mechanism of a known type.
Figure 2:
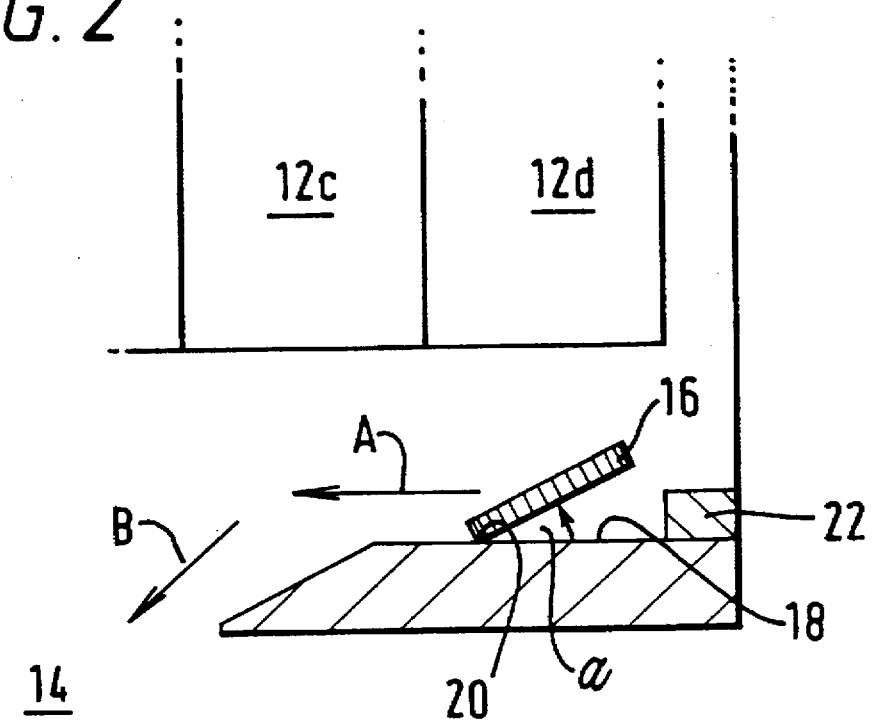
FIG. 2 is a cross-section of a portion of FIG. 1 in greater detail.
Figure 3:
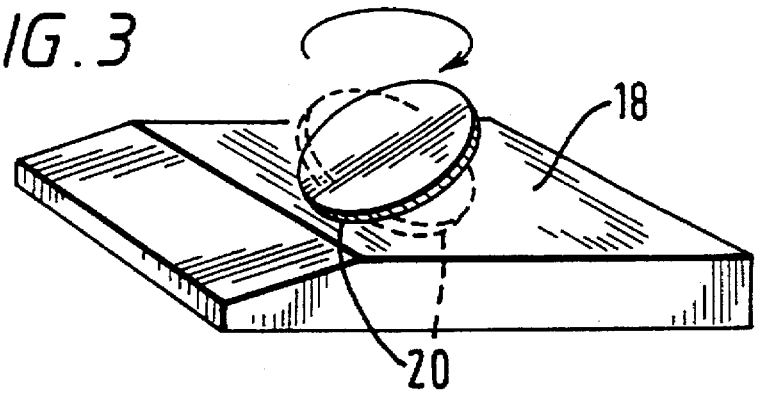
FIG. 3 is a perspective view of a coin in rolling motion.

A known coin mechanism 10 is shown in FIGS. 1 to 3. Coins enter the mechanism through a slot 2 and are validated in a validation area 4. On the basis of the validation, the coins are sorted by a sorter 6 and passed down one of a number of channels 8*a*, 8*b*, 8*c*, 8*d* according to their denomination. Rejected coins are ejected through a reject path (not shown). The coins are stored in vertical storage tubes 12*a*, 12*b*, 12*c*, 12*d*, each containing coins of a respective denomination. Each storage tube 12 includes a coin release mechanism (not shown) for releasing coins so that they may be dispensed. Typically, the coins are not dropped directly out of the storage tubes 12 but are first slid horizontally out of the storage tubes 12, in a direction perpendicular to the plane of FIG. 1, and then dropped.

It is often a desired feature of a coin dispenser that all coins should be dispensed within a small allocated area, for ease of collection by the user. For many applications the position of the allocated dispensing area on the front of the dispenser is often defined by written specifications such as the "BDV" specification for coin changing machines, which defines a dispensing area towards the bottom left-hand side of the front of the coin dispenser. In order to comply with this requirement, coins released from the storage tube 12*d* on the right-hand side of the apparatus 10 as shown in FIG. 1 must be moved horizontally, as shown by arrow A, towards the left-hand side of the apparatus 10 in order to fall, as shown by arrow B, into a dispensing area 14. The coin 16 is moved horizontally because it is undesirable to slide a coin down an inclined surface extending from below the storage tube 12*d* to the dispensing area 14, since the inclined surface would then occupy an undesirable amount of space in the vertical direction.

A detail of the known dispenser is shown in FIG. 2. In this figure, a coin 16 released from the storage tube 12*d* falls onto a surface 18 which is generally flat and horizontal. As the coin 16 falls, it is in a generally face down orientation, but its faces are actually inclined at a small angle $\alpha$ with respect to the surface 18, that angle $\alpha$ tending to vary from coin to coin. As a result, a corner 20 of the coin 16 strikes the surface 18 and the coin 16 exhibits a rolling motion in a circular path before coming to rest on the surface 18. This motion of the coin is of a very well known nature, similar to precessing, with only the lower corner 20 of the coin's edge in contact with the surface 18. A representation of this motion is shown in FIG. 3, with an alternative position of the coin 16 shown in broken outline.

Figure 4:
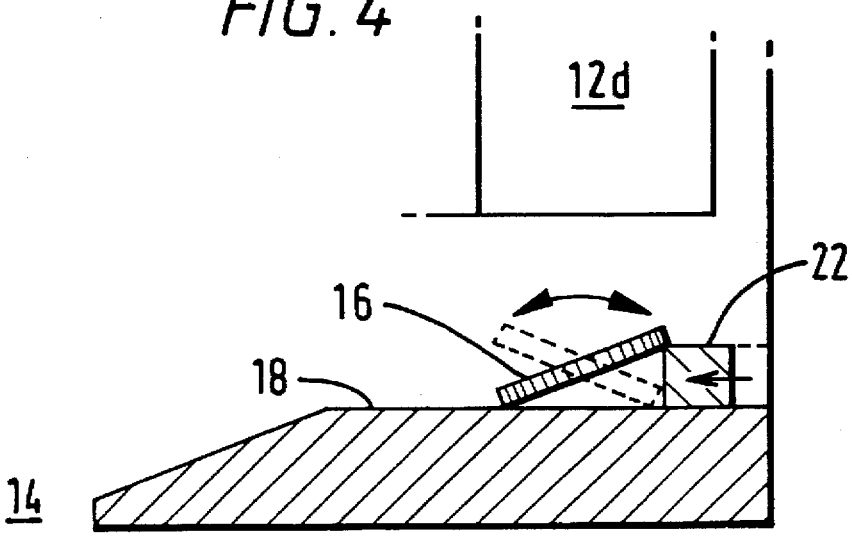
FIG. 4 is a cross-section as in FIG. 2 when an arm is actuated.

After a predetermined period of time, the coin 16 is pushed horizontally towards the dispensing area 14 by an arm 22, known as a scavenger arm, as shown in FIG. 4. The arm 22 is synchronised with the coin-releasing mechanism, both of which may be actuated by a rotating cam.

However, the length of time before the coin 16 comes to rest is variable and it is possible that the coin 16 is still rolling when the arm 22 is actuated. In that case, the side of the coin 16 facing the arm 22 may be momentarily raised when the arm 22 sweeps across the surface 18 and the coin 16 may then ride over the arm 22. As a result, the coin 16 is not moved a sufficient distance by the arm 22 to reach the dispensing area 14 and no coin is dispensed. Thus, reliable coin dispensing may only be achieved by setting the predetermined period of time between the release of the coin 16 and the actuation of the arm 22 to be sufficiently long that the coin 16 is certain to be at rest. This limits the rate at which coins may be dispensed to about one per second.

Figure 5:
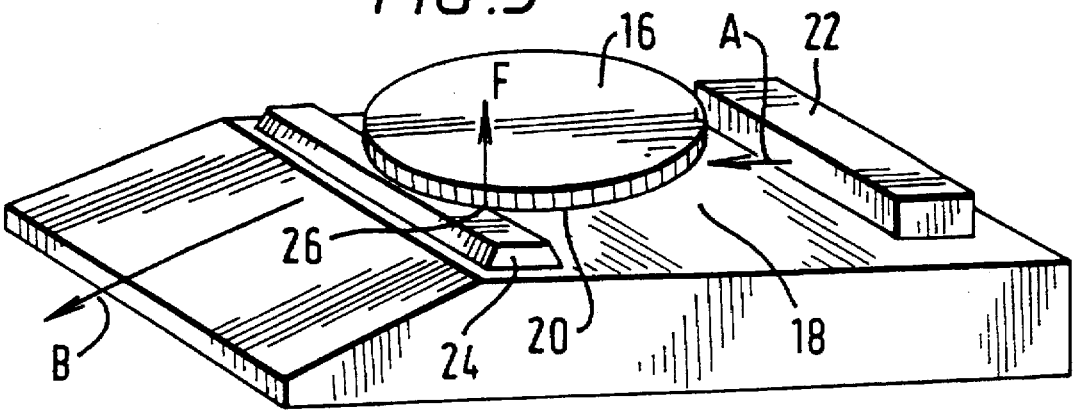
FIG. 5 is a perspective view of a portion of one embodiment of a coin dispenser according to the present invention.

FIG. 5 shows a strip 24 arranged on the surface 18. The strip 24 is positioned within the area of the surface 18 onto which the coin 16 is dispensed so that the coin 16 rolls onto the strip 24. The coin rolls round on its corner 20, onto the strip 24 and the rolling action of the coin 16 is disturbed, so that the coin 16 rapidly comes to rest.

It is believed that the effect of the strip 24 on the coin 16 can be represented by a substantially vertical force F exerted at point 26 at which the corner 20 of the coin 16 encounters the strip 24. The force F acts to lift one side of the coin 16 thereby transferring the kinetic energy of rolling of the coin 16 into potential energy. Thus, the rolling motion of the coin 16 is rapidly damped.

Figure 6A:
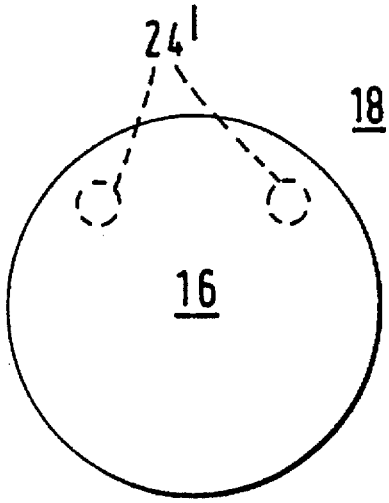
FIGS. 6*a*) to 6*c*) show, in schematic plan view, alternative embodiments of the raised portion according to the present invention.

There may be contemplated alternatives to the strip 24 within the scope of the present invention. For example, as shown in FIG. 6*a*) the strip 24 may be replaced by a pair of projecting studs 24' arranged to contact a chord of the coin 16. In that case, a face rather than a corner of the coin 16 encounters one of the studs 24', but the effect is still to lift one end of the coin 16 and to interrupt its rolling motion.

Figure 6B:
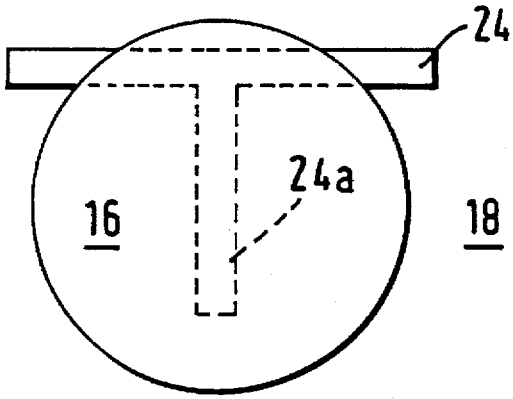

Alternatively, as shown in FIG. 6*b*), there may be added to the strip 24 a branch portion 24*a* extending from strip 24 at right angles in plan view, to form a "T"-shaped projecting portion.

Figure 6C:
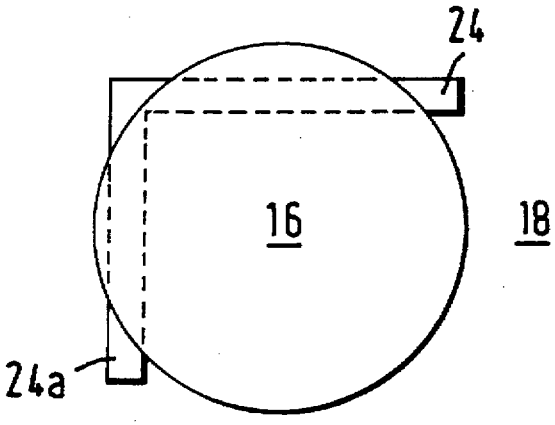

As another alternative, the branch portion 24*a*) may extend from one end of the strip 24, to form an "L"-shaped projecting portion, as shown in FIG. 6*c*). The branch portion 24*a*) further interrupts the rolling motion of the coin 16.

As a variant to FIG. 6*c*), the "L"-shaped projecting portion may be rotated so that the junction of the branch portion 24*a*) and the strip 24 points away from the scavenger arm 22, in the form of an inverted "V".

The leading edge of the scavenger arm 22 may be shaped to conform with the projecting portion 24. For example, the leading edge of the scavenger arm 22 may include a notch to cooperate with the branch portion 24*a*). Additionally, in the case that the arm 22 pivots along the surface 18, the branch portion 24*a*) and the notch may be curved.

The profile of the strip 24 is shown in FIG. 5 as a trapezium, but may alternatively be triangular or semicircular, for example. These alternative profiles reduce the risk of the coin 16 balancing on the top surface of the strip 24 when the coin is pushed over the strip 24 by the arm 22. The height of the strip 24 must be sufficiently low to allow the coin to be pushed easily over the strip 24, but sufficiently high to disturb the rolling motion of the coin 16. In one embodiment, the height of the strip 24 was 0.5 mm. Preferably, the height of the strip is between approximately 0.3 mm and 2 mm.

The arm 22 may be higher than the strip 24 and may include a portion which overlaps the top of the strip 24 to ensure that the coin 16 has been pushed over the strip 24.

The strip 24 may advantageously be formed of a plastics material to facilitate bonding to surface 18, which is normally of a plastics material. Thus, the strip 24 may easily be added to existing coin dispensers. Alternatively, the strip 24 may be made of a shock-absorbing material such as ceramic or steel, in order to absorb the energy of impact of the coin 16 and further assist damping. For ease of manufacture, the strip 24 may alternatively be formed integrally with the surface 18.

The coin 16 rapidly comes to rest with one side raised and resting on the strip 24 and the other side facing the arm 22 resting on the surface 18. Thus, the coin 16 is reliably contacted by the arm 22 and pushed over the strip 24 into the dispensing area 14. Thus, reliable and swift coin dispensing is achieved. In one embodiment of the present invention, coins were dispensed at a rate of three per second.

Although in the preferred illustrated embodiments the raised portion is directly below the position of the coin when it is released and dropped, this is not absolutely essential; the coin could instead be released onto a short ramp leading to the raised portion, for example.

The specific embodiments of the present invention are described above with reference to a coin. However, in this context it will be appreciated that the term "coin" includes within its scope articles such as tokens which are automatically dispensed and which are susceptible to circular rolling motion similar to that of coins.

What is claimed is:

1. A coin dispenser operable to release a coin so that it falls onto a receiving surface of the dispenser in such a way that the coin executes a rolling movement in a circular path, including a member actuatable to contact the coin and to push the coin from the receiving surface towards a dispensing area, the receiving surface having a raised portion disposed in the path of the coin executing said movement so that the coin rolls onto the raised portion and the rolling movement is damped so that the coin is reliably contactable by the member.

2. A coin dispenser as claimed in claim 1, wherein the raised portion comprises an elongated strip.

3. A coin dispenser as claimed in claim 1, in which the raised portion is at least partly located within an area directly below the position of the coin when released.

4. A coin dispenser as claimed in claim 1, in which the member is actuatable to push the coin over the raised portion.

5. A coin dispenser as claimed in claim 4, in which the raised portion is positioned to contact a side of the coin remote from the member so that the side of the coin adjacent the member rests on said surface when the motion of the coin is damped.

* * * * *